US006521578B1

(12) United States Patent
Stute et al.

(10) Patent No.: US 6,521,578 B1
(45) Date of Patent: Feb. 18, 2003

(54) CLEANING AGENTS FOR HARD SURFACES

(75) Inventors: Jutta Stute, Cologne (DE); Rita Koester, Duesseldorf (DE); Ditmar Kischkel, Monheim (DE); Antonino Burgo, Cantu (IT)

(73) Assignee: Cognis Deutschland GmbH, Duesseldorf (DE)

( * ) Notice: Subject to any disclaimer, the term of this patent is extended or adjusted under 35 U.S.C. 154(b) by 0 days.

(21) Appl. No.: 10/030,765

(22) PCT Filed: Apr. 13, 2000

(86) PCT No.: PCT/EP00/03314

§ 371 (c)(1),
(2), (4) Date: May 20, 2002

(87) PCT Pub. No.: WO00/65007

PCT Pub. Date: Nov. 2, 2000

(30) Foreign Application Priority Data

Apr. 22, 1999 (DE) ..... 199 18 188

(51) Int. Cl.[7] ..... C11D 1/04; C11D 1/75; C11D 1/83; C11D 3/22

(52) U.S. Cl. ..... 510/238; 510/191; 510/427; 510/428; 510/433; 510/470; 510/503

(58) Field of Search ..... 510/191, 238, 510/427, 428, 433, 470, 503

(56) References Cited

U.S. PATENT DOCUMENTS

| | | | | |
|---|---|---|---|---|
| 3,966,629 A | | 6/1976 | Dumbrell | 252/140 |
| 4,062,647 A | | 12/1977 | Storm et al. | 8/137 |
| 4,534,879 A | | 8/1985 | Iding et al. | 252/174 |
| 4,737,306 A | | 4/1988 | Wichelhaus et al. | 252/95 |
| 4,816,553 A | | 3/1989 | Baur et al. | 528/245 |
| 4,820,439 A | | 4/1989 | Rieck | 252/135 |
| 4,820,449 A | | 4/1989 | Menke et al. | 252/514 |
| 5,374,716 A | | 12/1994 | Biermann et al. | 536/18.6 |
| 5,417,951 A | | 5/1995 | Just | 423/334 |
| 5,576,425 A | | 11/1996 | Hill et al. | 536/18.6 |
| 5,719,118 A | * | 2/1998 | Crutcher et al. | 510/499 |
| 5,830,956 A | | 11/1998 | Stockhausen et al. | 526/318.2 |
| 5,854,321 A | | 12/1998 | Krause et al. | 524/58 |
| 5,939,372 A | | 8/1999 | Schmid et al. | 510/191 |

FOREIGN PATENT DOCUMENTS

| | | |
|---|---|---|
| DE | 2 334 899 | 1/1974 |
| DE | 35 26 405 | 2/1987 |
| DE | 42 21 381 | 2/1994 |
| DE | 43 37 032 | 5/1995 |
| DE | 43 00 772 | 3/1997 |
| DE | 19715872 | 10/1998 |
| EP | 0 014 979 | 9/1980 |
| EP | 0 026 529 | 4/1981 |
| EP | 0 028 432 | 1/1984 |
| EP | 0 164 514 | 12/1985 |
| EP | 0 265 979 | 5/1988 |
| EP | 0 301 298 | 2/1989 |
| EP | 0 280 223 | 10/1991 |
| EP | 0 268 967 | 6/1992 |
| GB | 1 400 898 | 7/1973 |
| WO | WO 90/03977 | 4/1990 |
| WO | WO 91/08171 | 6/1991 |

OTHER PUBLICATIONS

U.Ploog, "Amphotere Tenside, Aufbau, Eigenschaften und Anwendungsmöglichkeiten", pp. 373–376, Kosmeticka Aerosole Riechstoffe, Seifen–Ole–Fette–Wachse, vol. 108, Jg.—Nr. 12 (1982).

O'Lenick, Jr. et al., "Amphoteric Surfactants, A review of the Chemistry and Applications", pp. 70–74; 125–126, Happi, Nov. (1986).

Holzman, et al., "Amphoteric Surfactants, Amphoteric Surfactants of the Amphoglycinate and Amphocarboxyglycinate Type", pp. 309–313, Tenside Detergents, vol. 23, (1986).

Bilbo et al., "Amphoteric Surfactants, A Structure Function Study", pp. 46–50; 114–116, Soap/Cosmetics/Chemical Specialties (1990).

Ellis et al., "Amphoteric Surfactants—The Next Generation", pp. 14–17, Euro Cosmetics, vol. 1, (1994).

J. Falbe, "Surfactants in Consumer Products", pp. 54–124, Springer Verlag, Berlin (1987).

J. Falbe, "Katalysatoren, Tenside und Mineralöladditive", pp. 123–217, Thieme Verlag, Stuttgart, (1987).

C. Wischpflegemittel, "Qualitätsnormen für Fussbodenpflege—und—reinigungsmittel", pp. 371–372, Sieffen–Öle–Fette–Wachse, vol. 112, Jg.–Nr.10 (1986).

* cited by examiner

*Primary Examiner*—Gregory Delcotto
(74) *Attorney, Agent, or Firm*—John F. Drach; Steven J. Trzaska

(57) ABSTRACT

A hard surface cleaning composition containing: (a) from about 1 to 10% by weight of an alkyl or alkenyl oligoglycoside; (b) from about 1 to 10% by weight of an anionic surfactant selected from the group consisting of an alkyl or alkenyl sulfate, alkyl or alkenyl ether sulfate, a betaine, and mixtures thereof; (c) from about 0.1 to 15% by weight of an ethoxylated fatty amine having a formula:

$$R—NH(CH_2CH_2O)_zH$$

wherein R is a linear or branched, alkyl or alkenyl group having from about 6 to 22 carbon atoms, and z is a number from 1 to about 10; and (d) remainder to 100% water, all weights being based on the weight of the composition, and wherein the composition has a pH value of from about 1.5 to 3.

17 Claims, No Drawings

CLEANING AGENTS FOR HARD SURFACES

BACKGROUND OF THE INVENTION

This invention relates generally to cleaning and disinfecting compositions and more particularly to compositions containing a special surfactant combination and ethoxylated amines and to their use for the production of cleaning compositions.

For some time, flush toilets have been cleaned using solid toilet blocks which are either suspended in the cistern or fastened below the rim of the lavatory bowl. Their function is to clean the surface of the lavatory bowl during the flushing process and, in particular, to mask unpleasant odors through the release of fragrances. In view in particular of their function to release fragrances, cleaners for flush toilets are also generally referred to in the literature as perfume blocks. Surfactants, builders, inorganic salts and, of course, fragrances and dyes are normally used for their production. Several such formulations are known from the prior art literature. U.S. Pat. No. 4,534,879 (Procter & Gamble), for example, describes solid cleaning compositions which contain as their surfactant component $C_{9-15}$ alkyl sulfates, alkyl benzenesulfonates and inorganic salts. EP 0 265 979 A1 (Akzo) describes thickened water-based cleaners which contain mixtures of cationic surfactants and amine oxides together with short-chain aryl sulfonates. EP 0 014 979 A1 (Henkel) describes toilet blocks which contain alkyl benzenesulfonates and alkyl sulfates and also fatty alcohol or alkylphenol ethoxylates. DE 43 370 32 C2 (Henkel) relates to toilet blocks containing alkyl sulfates, alkyl ether sulfates and alkyl glucosides. EP-A 0 268 967 (Henkel) discloses toilet blocks containing sodium lauryl sulfate and fatty acid monoethanolamide. The described toilet blocks are generally produced by casting, compression molding, extrusion or granulation processes which involve high outlay on machinery and, in many cases, suffer unwanted losses of perfume under the effect of the high temperatures prevailing (casting/extrusion processes). Another disadvantage is that the refill units widely used on ecological grounds can only be used after the block has been exhausted. Although desirable, refilling as and when required, for example for a stronger release of active ingredients or, more particularly, for more intensive emission of perfume, is not possible.

German patent DE 197 15 872 A1 (Henkel) describes gel-form lavatory cleaners with pseudoplastic properties which significantly reduce production difficulties and which can be produced less expensively by virtue of the simple technology involved. The problem of individual refillability can also be solved by pseudoplastic formulations of the type in question. These known gel-form toilet cleaners contain polysaccharides, more particularly xanthan gum, for establishing their pseudoplastic properties and, as surfactants, alkyl polyglycosides (compulsory) and anionic and/or nonionic co-surfactants (optional). However, these gel-form cleaners have to be produced taking special precautionary measures during formation of the gel in order to ensure on the one hand that no bubbles are formed and, on the other hand, that the other ingredients are incorporated in uniform distribution in the gel.

Accordingly, the complex problem addressed by the invention was to provide new cleaning compositions for hard surfaces, but preferably gel-form lavatory cleaners, that would have a viscosity which, on the one hand, would allow easy application and, on the other hand, would prevent them draining too quickly, even on inclined surfaces, in order to guarantee as long a contact time as possible. In addition, the compositions would have improved cleaning performance, would be bactericidal and would retain their advantageous viscosity without the use of typical thickeners. In addition, the compositions would exhibit good initial foaming behavior, would allow the incorporation of various perfume oils, even in large quantities, and finally would have a long useful life, i.e. would allow the lavatory to be flushed many times before exhaustion of the cleaning composition (flush count).

DESCRIPTION OF THE INVENTION

The present invention relates to cleaning compositions for hard surfaces containing (a) alkyl and/or alkenyl oligoglycosides, (b) alkyl and/or alkenyl (ether) sulfates and/or betaines and (c) ethoxylated fatty amines.

It has surprisingly been found that the compositions according to the invention not only have an excellent cleaning performance and bactericidal effect, they also have a much higher viscosity than conventional compositions, even without thickeners, and show pseudoplastic behavior. Accordingly, the compositions according to the invention are distinguished not only by easy application and excellent drainage behavior, they also have a high foaming capacity, allow the incorporation of various perfumes, even in relatively large quantities, and—by virtue of their gel-like consistency—can be reliably "dosed" over prolonged periods, above all even from containers, for example in cisterns of lavatories. In addition, the water-based compositions may be completely or partly freed from water and compressed into blocks.

Alkyl and/or Alkenyl Oligoglycosides

Alkyl and alkenyl oligoglycosides which form component (a) are known nonionic surfactants which correspond to formula (I):

$$R^1O—[G]_p \qquad (I)$$

where $R^1$ is an alkyl and/or alkenyl group containing 4 to 22 carbon atoms, G is a sugar unit containing 5 or 6 carbon atoms and p is a number of 1 to 10. They may be obtained by the relevant methods of preparative organic chemistry. EP 0 301 298 A1 and WO 90/03977 are cited as representative of the extensive literature available on the subject. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (I) indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl group $R^1$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl group $R^1$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut oil fatty alcohol having a DP of 1 to 3 are preferred.

Alkyl and/or Alkenyl Sulfates

Alkyl and/or alkenyl sulfates, which are often referred to as fatty alcohol or oxoalcohol sulfates and which form component (b1), are the sulfation products of primary alcohols which correspond to formula (II):

$$R^2O—SO_3X \quad (II)$$

in which $R^2$ is a linear or branched aliphatic alkyl and/or alkenyl group containing 6 to 22 carbon atoms, preferably 12 to 18 carbon atoms and X is an alkali metal and/or alkaline earth metal, ammonium, alkylammonium, alkanolammonium or glucammonium. Typical examples of alkyl sulfates which may be used for the purposes of the invention are the sulfation products of caproic alcohol, caprylic alcohol, capric alcohol, 2-ethylhexyl alcohol, lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol and erucyl alcohol and the technical mixtures thereof obtained by high-pressure hydrogenation of technical methyl ester fractions or aldehydes from Roelen's oxo synthesis. The sulfation products may advantageously be used in the form of their alkali metal salts, more particularly their sodium salts. Alkyl sulfates based on $C_{16/18}$ tallow fatty alcohols or vegetable fatty alcohols of comparable C-chain distribution in the form of their sodium salts are particularly preferred.

Alkyl and/or Alkenyl Ether Sulfates

Alkyl ether sulfates ("ether sulfates") which form component (b2) are also known anionic surfactants which are industrially produced by the sulfation of fatty alcohol or oxoalcohol polyglycol ethers with $SO_3$ or chlorosulfonic acid (CSA) and subsequent neutralization. Ether sulfates suitable for the purposes of the invention correspond to formula (III):

$$R^3O—(CH_2CH_2O)_nSO_3X \quad (III)$$

in which $R^3$ is a linear or branched alkyl and/or alkenyl group containing 6 to 22 carbon atoms, n is a number of 1 to 10 and X is an alkali metal and/or alkaline earth metal, ammonium, alkylammonium, alkanolammonium or glucammonium. Typical examples are the sulfates of addition products of on average 1 to 10 and, more particularly, 2 to 5 moles of ethylene oxide onto caproic alcohol, caprylic alcohol, 2-ethyl hexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and brassidyl alcohol and technical mixtures thereof in the form of their sodium and/or magnesium salts. The ether sulfates may have both a conventional homolog distribution and a narrow homolog distribution. It is particularly preferred to use ether sulfates based on adducts of, on average, 2 to 3 moles of ethylene oxide with technical $C_{12/14}$ or $C_{12/18}$ coconut fatty alcohol fractions in the form of their sodium and/or magnesium salts.

Betaines

Betaines which form component (b3) are known surfactants which are mainly produced by carboxyalkylation, preferably carboxymethylation, of aminic compounds. The starting materials are preferably condensed with halocarboxylic acids or salts thereof, more particularly with sodium chloroacetate, 1 mole of salt being formed per mole of betaine. The addition of unsaturated carboxylic acids, for example acrylic acid, is also possible. Particulars of the nomenclature and, in particular, the distinction between betaines and "genuine" amphoteric surfactants can be found in the article by U. Ploog in Seifen-Öle-Fette-Wachse, 198, 373 (1982). Other reviews of this subject have been published, for example, by A. O'Lenick et al. in HAPPI, Nov. 70 (1986), by S. Holzman et al. in Tens. Surf. Det. 23, 309 (1986), by R. Bibo et al. in Soap Cosm. Chem. Spec., Apr. 46 (1990) and by P. Ellis et al. in Euro Cosm. 1, 14 (1994). Examples of suitable betaines are the carboxyalkylation products of secondary and, in particular, tertiary amines corresponding to formula (IV):

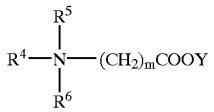

(IV)

in which $R^4$ stands for alkyl and/or alkenyl groups containing 6 to 22 carbon atoms, $R^5$ stands for hydrogen or alkyl groups containing 1 to 4 carbon atoms, $R^6$ stands for alkyl groups containing 1 to 4 carbon atoms, m is a number of 1 to 6 and Y is an alkali metal and/or alkaline earth metal or ammonium. Typical examples are the carboxymethylation products of hexyl methyl amine, hexyl dimethyl amine, octyl dimethyl amine, decyl dimethyl amine, dodecyl methyl amine, dodecyl dimethyl amine, dodecyl ethyl methyl amine, $C_{12/14}$ cocoalkyl dimethyl amine, myristyl dimethyl amine, cetyl dimethyl amine, stearyl dimethyl amine, stearyl ethyl methyl amine, oleyl dimethyl amine, $C_{16/18}$ tallow alkyl dimethyl amine and technical mixtures thereof. Other suitable betaines are carboxyalkylation products of amidoamines corresponding to formula (V):

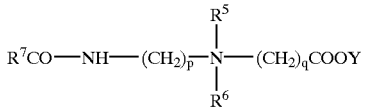

(V)

in which $R^7CO$ is an aliphatic acyl group containing 6 to 22 carbon atoms and 0 or 1 to 3 double bonds, $R^5$ is hydrogen or an alkyl group containing 1 to 4 carbon atoms, $R^6$ is an alkyl group containing 1 to 4 carbon atoms, p and q independently of one another are numbers of 1 to 6 and Y is an alkali metal and/or alkaline earth metal or ammonium. Typical examples are reaction products of fatty acids containing 6 to 22 carbon atoms, namely caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof, with N,N-dimethyl aminoethyl amine, N,N-dimethyl aminopropyl amine, N,N-diethyl aminoethyl amine and N,N-diethyl aminopropyl amine which are condensed with sodium chloroacetate. It is preferred to use a condensation product of $C_{8/18}$ cocofatty acid-N,N-dimethyl aminopropyl amide with sodium chloroacetate.

Ethoxylated Fatty Amines

Ethoxylated fatty amines which form component (c) preferably correspond to general formula (VI):

$$R^8—NH(CH_2CH_2O)_zH \quad (VI)$$

in which $R^8$ represents linear or branched alkyl and/or alkenyl groups containing 6 to 22 and preferably 12 to 18 carbon atoms and z is a number of 1 to 30, preferably 2 to 20 and more particularly 3 to 10. Typical examples are products of the addition of, on average, 1 to 30, preferably 2 to 20 and more particularly 3 to 10 moles ethylene oxides onto caprylamine, caprylyl amine, capronyl amine, lauryl amine, myristyl amine, cetyl amine, stearyl amine, isostearyl amine, oleyl amine, elaidyl amine, petroselinyl amine, behenyl amine and erucyl amine and mixtures thereof. The ethoxylates may have a broad or narrow homolog distribution.

Commercial Applications

In order to establish an acidic pH value, the compositions according to the invention may contain mineral acids, for example hydrochloric acidor phosphoric acid, or even organic acids, for example formic acid, adipic acid, tartaric acid or preferably citric acid. The quantity used is dependent on the required pH value which, in particular, should be in the range from 1.5 to 3. In one preferred embodiment of the invention, the compositions contain (a) 1 to 10, preferably 2 to 5% by weight alkyl and/or alkenyl oligoglycosides, (b) 1 to 10, preferably 2 to 5% by weight alkyl and/or alkenyl (ether) sulfates and/or betaines and (c) 0.1 to 15, preferably 5 to 11% by weight ethoxylated fatty amines, with the proviso that the quantities shown add up to 100% by weight with water and optionally other auxiliaries and additives.

The present invention also relates to the use of mixtures containing (a) alkyl and/or alkenyl oligoglycosides, (b) alkyl and/or alkenyl (ether) sulfates and/or betaines and (c) ethoxylated fatty amines for the production of cleaning compositions for hard surfaces, preferably gel-form lavatory cleaners.

Finally, the present invention relates to the use of ethoxylated fatty amines as thickeners for water-based surfactant systems, preferably water-based cleaners, in which they may be present in quantities of 0.1 to 15, preferably 1 to 10 and more particularly 2 to 5% by weight, based on the cleaner.

Auxiliaries and Additives

The gel-form cleaning compositions according to the invention may additionally contain co-surfactants, lime-dissolving agents, builders, perfumes, perfume solubilizers, solvents, germ inhibitors, preservatives, dyes, pH adjusters and the like.

Suitable co-surfactants are nonionic, anionic, cationic and/or amphoteric or zwitterionic surfactants which normally make up about 1 to 5% by weight and preferably 2 to 3% by weight of the compositions. Typical examples of anionic surfactants are soaps, alkyl benzene-sulfonates, alkane sulfonates, olefin sulfonates, alkyl ether sulfonates, glycerol ether sulfonates, α-methyl ester sulfonates, sulfo-fatty acids, glycerol ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acyl amino acids such as, for example, acyl lactylates, acyl tartrates, acyl glutamates and acyl aspartates, alkyl oligoglucoside sulfates, protein fatty acid condensates (more particularly vegetable wheat-based products) and alkyl (ether)phosphates. Where the anionic surfactants contain polyglycol ether chains, they may have a conventional homolog distribution although they preferably have a narrow homolog distribution. Typical examples of nonionic surfactants are fatty alcohol polyglycol ethers, alkylphenol polyglycol ethers, fatty acid polyglycol esters, fatty acid amide polyglycol ethers, alkoxylated triglycerides, (hydroxy) mixed ethers and mixed formals, optionally partially oxidized glucuronic acid derivatives, fatty acid-N-alkyl glucamides, protein hydrolyzates (particularly wheat-based vegetable products), polyol fatty acid esters, sugar esters, sorbitan esters, polysor bates and amine oxides. If the nonionic surfactants contain polyglycol ether chains, they may have a conventional homolog distribution, although they preferably have a narrow homolog distribution. Typical examples of cationic surfactants are esterquats and tetraalkyl ammonium compounds. The surfactants mentioned are all known compounds. Information on their structure and production can be found in relevant synoptic works, cf. for example J. Falbe (ed.), "*Surfactants in Consumer Products*", Springer Verlag, Berlin, 1987, pages 54 to 124 or J. Fall (ed.), "*Katalysatoren, Tenside und Mineralöladditive* (*Catalysts, Surfactants and Mineral Oil Additives*)", Thieme Verlag, Stuttgart, 1978, pages 123–217. Alcohol ethoxylates, hydroxy mixed ethers, fatty acid methyl ester ethoxylates and/or amine oxides are preferably used as co-surfactants.

Preferred lime-dissolving agents are lime-dissolving acids, such as citric acid, formic acid, acetic acid, lactic acid or water-soluble salts thereof which may be used in a quantity—based on the composition—of 1 to 12% by weight and preferably 2 to 7% by weight.

Other optional ingredients of the compositions according to the invention are builders, preferably water-soluble builders because they generally tend less to form insoluble residues on hard surfaces. Suitable liquid water-soluble builders are ethylenediamine tetraacetic acid, nitrilotriacetic acid, citric acid and inorganic phosphonic acids such as, for example, the neutrally reacting sodium salts of 1-hydroxyethane-1,1-diphosphonate which may be present in quantities of 0.5 to 5 and preferably 1 to 2% by weight. Suitable solid or water-insoluble builders are, in particular, finely crystalline zeolite containing synthetic and bound water, such as detergent-quality zeolite NaA. However, zeolite NaX and mixtures of NaA and NaX are also suitable. The zeolite may be used in the form of a spray-dried powder or even as an undried stabilized suspension still moist from its production. Where the zeolite is used in the form of a suspension, the suspension may contain small additions of nonionic surfactants as stabilizers, for example 1 to 3% by weight—based on zeolite—of ethoxylated $C_{12-18}$ fatty alcohols containing 2 to 5 ethylene oxide groups or ethoxylated isotridecanols. Suitable zeolites have a mean particle size of less than 10 pm (volume distribution, as measured by the Coulter Counter Method) and contain preferably 18 to 22% by weight and more preferably 20 to 22% by weight of bound water. Suitable substitutes or partial substitutes for zeolites are crystalline layer-form sodium silicates with the general formula $NaMSi_xO_{2x+1}.yH_2O$, where M is sodium or hydrogen, x is a number of 1.9 to 4 and y is a number of 0 to 20, preferred values for x being 2, 3 or 4. Crystalline layer silicates such as these are described, for example, in European patent application EP 0 164 514 A1. Preferred crystalline layer silicates are those in which M in the general formula stands for sodium and x assumes the value 2 or 3. Both β- and γ-sodium disilicates $Na_2Si_2O_5.yH_2O$ are particularly preferred, β-sodium disilicate being obtainable for example by the process described in International patent application WO 91/08171. The compositions according to the invention preferably contain 10 to 60% by weight of zeolite and/or crystalline layer silicates as solid builders, mixtures of zeolite and crystalline layer silicates in any ratio being particularly advantageous. In one particularly preferred embodiment, the compositions contain 20 to 50% by weight of zeolite and/or crystalline layer silicates. Particularly preferred detergents contain up to 40% by weight of zeolite and, more particularly, up to 35% by weight of zeolite, based on water-free active substance. Other suitable ingredients of the detergents are water-soluble amorphous silicates which are preferably used in combination with zeolite and/or crystalline layer silicates. Particularly preferred detergents are those which contain above all sodium silicate with a molar ratio of $Na_2O$ to $SiO_2$ (modulus) of 1:1 to 1:4.5 and preferably 1:2 to 1:3.5. The amorphous sodium silicate content of the compositions is preferably up to 15% by weight and more preferably from 2 to 8% by weight. Phosphates, such as tripolyphosphates, pyrophosphates and orthophosphates, may also be present in the compositions in small quantities. The phosphate content of the compositions is preferably up to 15% by weight and, more particularly, from 0 to 10% by weight. In addition, the compositions may contain layer silicates of natural and synthetic origin. Corresponding layer silicates are known, for example, from patent applications DE 23 34 899 B1, EP 0 026 529 A1 and DE 35 26 405 A1. Their suitability for use is not confined to a particular composition or structural formula. However, smectites are preferred, bentonites being particularly preferred. Suitable layer silicates which belong to the group of water-swellable smectites are, for example, those corresponding to the following general formulae:

$(OH)_4Si_{8-y}Al_y(Mg_xAl_{4-x})O_{20}$ montmorillonite $(OH)_4Si_{8-y}Al_y(Mg_{6-z}Li_z)O_{20}$ hectorite $(OH)_4Si_{8-y}Al_y(Mg_{6-z}Al_z)O_{20}$ saponite where x=0 to 4, y=0 to 2 and z=0 to 6. In addition, small quantities of iron may be incorporated in the crystal lattice of the layer silicates corresponding to the above formulae. By virtue of their ion-exchanging properties, the layer silicates may also contain hydrogen, alkali metal and alkaline earth metal ions, more particularly $Na^+$ and $Ca^{2+}$. The quantity of water of hydration is generally in the range from 8 to 20% by weight and is dependent upon the degree of swelling and upon the processing method. Suitable layer silicates are known, for example, from U.S. Pat. No. 3,966,629, U.S. Pat. No. 4,062,647, EP 0 026 529 A1 and EP 0 028 432 A1. Layer silicates which have been substantially freed from calcium ions and strongly coloring iron ions by an alkali treatment are preferably used. Useful organic builders are, for example, the polycarboxylic acids preferably used in the form of their sodium salts, such as citric acid, adipic acidic acid, succinic acid, glutaric acid, tartaric acid, sugar acids, aminocarboxylic acids, nitrilotriacetic acid (NTA), providing their use is not ecologically unsafe, and mixtures thereof. Preferred salts are the salts of polycarboxylic acids, such as citric acid, adipic acid, succinic acid, glutaric acid, tartaric acid, sugar acids and mixtures thereof. Suitable polymeric polycarboxylates are, for example, the sodium salts of polyacrylic acid or polymethacrylic acid, for example those with a relative molecular weight of 800 to 150,000 (based on acid). Suitable copolymeric polycarboxylates are, in particular, those of acrylic acid with methacrylic acid and acrylic acid or methacrylic acid with maleic acid. Copolymers of acrylic acid with maleic acid which contain 50 to 90% by weight of acrylic acid and 50 to 10% by weight of maleic acid are particularly suitable. Their relative molecular weight, based on free acids, is generally in the range from 5,000 to 200,000, preferably in the range from 10,000 to 120,000 and more preferably in the range from 50,000 to 100,000. It is not absolutely essential to use polymeric polycarboxylates. However, if polymeric polycarboxylates are used, detergents containing biodegradable polymers, for example terpolymers which contain acrylic acid and maleic acid or salts thereof and vinyl alcohol or vinyl alcohol derivatives as monomers or acrylic acid and 2-alkyl allyl sulfonic acid or salts thereof and sugar derivatives as monomers are preferred. The terpolymers obtained in accordance with the teaching of German patent applications DE 42 21 381 A1 and DE 43 00 772 A1 are particularly preferred. Other suitable builders are polyacetals which may be obtained by reacting dialdehydes with polyol carboxylic acids containing 5 to 7 carbon atoms and at least 3 hydroxyl groups, for example as described in European patent application EP 0 280 223 A1. Preferred polyacetals are obtained from dialdehydes, such as glyoxal, glutaraldehyde, terephthal-aldehyde and mixtures thereof and from polyol carboxylic acids, such as gluconic acid and/or glucoheptonic acid. The group of citrates is particularly preferred. The builders may be present in the compositions according to the invention in quantities of 0 to 5% by weight.

The hygienic effect may be enhanced by the addition of germ inhibitors. Suitable germ inhibitors are in particular isothiazoline mixtures, sodium benzoate and/or salicylic acid. Other examples are substances which act specifically against gram-positive bacteria such as, for example, 2,4,4'-trichloro-2'-hydroxydiphenyl ether, chlorhexidine (1,6-di-(4-chlorophenylbiguanido)-hexane) or TCC (3,4,4'-trichlorocarbanilide). Numerous perfumes and essential oils also have antimicrobial properties. Typical examples are the active substances eugenol, menthol and thymol in clove, mint and thyme oil. An interesting natural germ inhibitor is the terpene alcohol farnesol (3,7,11-trimethyl-2,6,10-dodecatrien-1-ol) which is present in linden blossom oil and which smells of lily-of-the-valley. Glycerol monolaurate has also been successfully used as a bacteriostatic agent. The germ inhibitor content depends largely on the effectiveness of the particular compound and may be up to 5% by weight. The germ inhibitors are preferably present in quantities of 0 to 10% by weight and more particularly in quantities of 0.01 to 7% by weight.

The additional perfumes optionally present are those known from the prior art. Mixtures of natural and synthetic perfumes are mentioned as examples. Natural perfumes are extracts of blossoms (lily, lavender, rose, jasmine, neroli, ylang-ylang), stems and leaves (geranium, patchouli, petitgrain), fruits (anise, coriander, caraway, juniper), fruit peel (bergamot, lemon, orange), roots (nutmeg, angelica, celery, cardamon, costus, iris, calmus), woods (pinewood, sandalwood, guaiac wood, cedarwood, rosewood), herbs and grasses (tarragon, lemon grass, sage, thyme), needles and branches (spruce, fir, pine, dwarf pine), resins and balsams (galbanum, elemi, benzoin, myrrh, olibanum, opoponax). Animal raw materials, for example civet and beaver, may also be used. Typical synthetic perfume compounds are products of the ester, ether, aldehyde, ketone, alcohol and hydrocarbon type. Examples of perfume compounds of the ester type are benzyl acetate, phenoxyethyl isobutyrate, p-tert.butyl cyclohexylacetate, linalyl acetate, dimethyl benzyl carbinyl acetate, phenyl ethyl acetate, linalyl benzoate, benzyl formate, ethylmethyl phenyl glycinate, allyl cyclohexyl propionate, styrallyl propionate and benzyl salicylate. Ethers include, for example, benzyl ethyl ether while aldehydes include, for example, the linear alkanals containing 8 to 18 carbon atoms, citral, citronellal, citronellyloxyacetaldehyde, cyclamen aldehyde, hydroxycitronellal, lilial and bourgeonal. Examples of suitable ketones are the ionones, α-isomethylionone and methyl cedryl ketone. The hydrocarbons mainly include the terpenes and balsams. However, it is preferred to use mixtures of different perfume compounds which, together, produce an agreeable fragrance. Other suitable perfume oils are essential oils of relatively low volatility which are mostly used as aroma components. Examples are sage oil, camomile oil, clove oil, melissa oil, mint oil, cinnamon leaf oil, lime-blossom oil, juniper berry oil, vetiver oil, olibanum oil, galbanum oil, labolanum oil and lavendin oil. The following are preferably used either individually or in the form of mixtures: bergamot oil, dihydromyrcenol, lilial, lyral, citronellol, phenylethyl alcohol, α-hexyl-cinnamaldehyde, geraniol, benzyl acetone, cyclamen aldehyde, linalool, Boisambrene Forte, Ambroxan, indole, hedione, sandelice, citrus oil, mandarin oil, orange oil, allylamyl glycolate, cyclovertal, lavendin oil, clary oil, β-damascone, geranium oil bourbon, cyclohexyl salicylate, Vertofix Coeur, Iso-E-Super, Fixolide NP, evernyl, iraldein gamma, phenylacetic acid, geranyl acetate, benzyl acetate, rose oxide, romillat, irotyl and floramat. The size of the perfume dose is determined by the required perfume intensity and is in the range from 0 to 15% by weight.

Perfume solubilizers which may be present in the compositions according to the invention include polyol fatty acid esters, for example coconut fatty acid-esterified glycerol alkoxylated with 7 moles ethylene oxide (Cetiol HE®, Henkel KGaA) and/or hydrogenated castor oil alkoxylated with 40 or 60 moles ethylene oxide (Eumulgin® HRE 40 or 60, Henkel KGaA) and/or 2-hydroxyfatty alcohol ethoxylates (Eumulgin® L, Henkel KGaA). The quantity of perfume solubilizers in the compositions according to the invention is generally between 0 and 10% by weight and preferably between 1 and 7% by weight.

Solvents which may be present in the compositions according to the invention, more particularly for dyes and perfume oils, include for example alkanolamines, polyols, such as ethylene glycol, propylene glycol, 1,2-glycerol and other monohydric and polyhydric alcohols and also alkyl benzenesulfonates with 1 to 3 carbon atoms in the alkyl moiety. The group of lower alcohols is particularly preferred, ethanol being most particularly preferred. The solvent content depends on the type and quantity of constituents to be dissolved and is generally in the range from 0.5 to 5% by weight.

The preferably water-soluble dyes are present either for coloring the product or for coloring the liquid circulating around the container. In a preferred embodiment, the content of water-soluble dyes is below 1% by weight and is intended to improve the appearance of the product. If an additional color signal is required during flushing, the content of water-soluble dyes may be increased to 5% by weight.

EXAMPLES

Various lavatory gels were prepared and tested for their cleaning performance to the IPP standard (soil 78/19, undiluted application) and their viscosity (Brookfield RVT viscosimeter, 20° C., spindle 1, 10 r.p.m., cf. *Seifen-Öle-Fette-Wachse*, 112, 371, 1988). The results are set out in Table 1. Examples 1 to 4 correspond to the invention, Examples C1 and C2 are intended for comparison. All quantities represent percentages by weight.

TABLE 1

Composition of various lavatory gel blocks

| Composition/ performance | 1 | 2 | 3 | 4 | C1 | C2 |
|---|---|---|---|---|---|---|
| Glucopon ® APG 650 EC Lauryl Glucoside | 5.0 | 1.5 | 1.5 | 1.5 | 5.0 | 1.5 |
| Glucopon ® APG 220 UP Decyl Glucoside | — | 3.5 | 3.5 | 3.5 | — | 3.5 |
| Texapon ® LS 35 Sodium Lauryl Sulfate | 9.0 | 6.0 | 3.0 | — | 9.0 | 6.0 |
| Texapon ® NSO Sodium Laureth Sulfate | — | 3.0 | — | — | — | 3.0 |
| Dehyton ® K Cocamidopropyl Betaine | — | — | 6.0 | 9.0 | — | — |
| Ethanol | 3.5 | 3.5 | 3.5 | 3.5 | 3.5 | 3.5 |
| Citric Acid Mono Hydrate | 3.6 | 3.6 | 3.6 | 3.6 | 3.6 | 3.6 |
| Sodium Hydroxide | 0.5 | 0.5 | 0.5 | 0.5 | 0.5 | 0.5 |
| Lauryl amine + 1 EO | 4.5 | — | 5.0 | — | — | — |
| Lauryl amine + 4 EO | — | 4.5 | — | 2.5 | — | — |
| Hexane-1,6-diol | — | 0.5 | — | | — | — |
| Geraniol | 0.5 | — | — | 2.5 | — | — |
| Water | | | to 100 | | | |
| Viscosity [mPas] | 580 | 610 | 610 | 590 | 120 | 100 |
| Cleaning performance [%-refl.] | 58 | 59 | 57 | 55 | 44 | 49 |

What is claimed is:

1. A hard surface cleaning composition comprising:

(a) from about 1 to 10% by weight of an alkyl or alkenyl oligoglycoside;

(b) from about 1 to 10% by weight of an anionic surfactant selected from the group consisting of an alkyl or alkenyl sulfate, alkyl or alkenyl ether sulfate, a betaine, and mixtures thereof;

(c) from about 0.1 to 15% by weight of an ethoxylated fatty amine having a formula:

$$R—NH(CH_2CH_2O)_zH$$

wherein R is a linear or branched, alkyl or alkenyl group having from about 6 to 22 carbon atoms, and z is a number from 1 to about 10; and (d) remainder to 100% water, all weights being based on the weight of the composition, and wherein the composition has a pH value of from about 1.5 to 3.

2. The composition of claim 1 wherein the alkyl or alkenyl oligoglycoside is present in the composition in an amount of from about 2 to 5% by weight, based on the weight of the composition.

3. The composition of claim 1 wherein the anionic surfactant is present in the composition in an amount of from about 2 to 5% by weight, based on the weight of the composition.

4. The composition of claim 1 wherein the ethoxylated fatty amine is present in the composition in an amount of from about 5 to 11% by weight, based on the weight of the composition.

5. A toilet bowl cleaner containing the composition of claim 1.

6. A process for cleaning a toilet bowl comprising contacting the toilet bowl with a composition containing:

(a) from about 1 to 10% by weight of an alkyl or alkenyl oligoglycoside;

(b) from about 1 to 10% by weight of an anionic surfactant selected from the group consisting of an alkyl or alkenyl sulfate, alkyl or alkenyl ether sulfate, a betaine, and mixtures thereof;

(c) from about 0.1 to 15% by weight of an ethoxylated fatty amine having a formula:

$$R—NH(CH_2CH_2O)_zH$$

wherein R is a linear or branched, alkyl or alkenyl group having from about 6 to 22 carbon atoms, and z is a number from 1 to about 10; and (d) remainder to 100% water, all weights being based on the weight of the composition, and wherein the composition has a pH value of from about 1.5 to 3.

7. The process of claim 5 wherein the alkyl or alkenyl oligoglycoside is present in the composition in an amount of from about 2 to 5% by weight, based on the weight of the composition.

8. The process of claim 5 wherein the anionic surfactant is present in the composition in an amount of from about 2 to 5% by weight, based on the weight of the composition.

9. The process of claim 5 wherein the ethoxylated fatty amine is present in the composition in an amount of from about 5 to 11% by weight, based on the weight of the composition.

10. A process for making a toilet bowl cleaner comprising:

(a) providing from about 1 to 10% by weight of an alkyl or alkenyl oligoglycoside;

(b) providing from about 1 to 10% by weight of an anionic surfactant selected from the group consisting of an alkyl or alkenyl sulfate, alkyl or alkenyl ether sulfate, a betaine, and mixtures thereof;

(c) providing from about 0.1 to 15% by weight of an ethoxylated fatty amine having a formula:

$$R—NH(CH_2CH_2O)_zH$$

wherein R is a linear or branched, alkyl or alkenyl group having from about 6 to 22 carbon atoms, and z is a number from 1 to about 10;

(d) providing remainder to 100% water, all weights being based on the weight of the composition; and (e) combining (a)–(d) to form the toilet bowl cleaner, and wherein the toilet bowl cleaner has a pH value of from about 1.5 to 3.

11. The process of claim 9 wherein the alkyl or alkenyl oligoglycoside is present in the toilet bowl cleaner in an amount of from about 2 to 5% by weight, based on the weight of the composition.

12. The process of claim 9 wherein the anionic surfactant is present in the toilet bowl cleaner in an amount of from about 2 to 5% by weight, based on the weight of the composition.

13. The process of claim 9 wherein the ethoxylated fatty amine is present in the toilet bowl cleaner in an amount of from about 5 to 11% by weight, based on the weight of the composition.

14. The product of the process of claim 9.

15. The product of the process of claim 10.

16. The product of the process of claim 11.

17. The product of the process of claim 12.

* * * * *